US005359353A

United States Patent [19]

Hunt et al.

[11] Patent Number: 5,359,353

[45] Date of Patent: Oct. 25, 1994

[54] SPRING-BAG PRINTER INK CARTRIDGE WITH VOLUME INDICATOR

[75] Inventors: David S. Hunt, San Diego; W. Bruce Reid, Socana Beach, both of Calif.

[73] Assignee: Hewlett-Packard Company, Palo Alto, Calif.

[21] Appl. No.: 717,735

[22] Filed: Jun. 19, 1991

[51] Int. Cl.[5] ..... B41J 2/17

[52] U.S. Cl. ..... 347/86; 73/290 R; 116/227; 116/281; 222/23

[58] Field of Search ..... 346/140 R; 222/23, 41, 222/45; 73/290 R; 116/227, 278, 281

[56] References Cited

U.S. PATENT DOCUMENTS

| | | | |
|---|---|---|---|
| 4,016,885 | 4/1977 | Bruner | 116/268 |
| 4,196,625 | 4/1980 | Kern | 73/304 R |
| 4,202,267 | 5/1980 | Heinzl et al. | 101/364 |
| 4,371,790 | 2/1983 | Manning et al. | 307/118 |
| 4,415,886 | 11/1983 | Kyogoku et al. | 340/618 |
| 4,422,084 | 12/1983 | Saito | 346/140 R |
| 4,447,820 | 5/1984 | Terasawa | 346/140 R |
| 4,587,535 | 5/1986 | Watanabe | 346/140 R |
| 4,626,874 | 12/1986 | Murai et al. | 346/140 R |
| 4,719,475 | 1/1988 | Kiyohara et al. | 346/140 R |
| 4,935,751 | 6/1990 | Hamlin | 346/140 R |
| 5,079,570 | 1/1992 | Mohr et al. | 346/140 R |
| 5,152,427 | 10/1992 | Pope et al. | 222/23 |
| 5,280,300 | 1/1994 | Fong et al. | 346/140 R X |

FOREIGN PATENT DOCUMENTS

| | | | |
|---|---|---|---|
| 61-233546 | 10/1986 | Japan | 346/140 R |
| 62-204951 | 9/1987 | Japan | 346/140 R |
| 63-3957 | 1/1988 | Japan | 346/140 R |

*Primary Examiner*—Benjamin R. Fuller
*Assistant Examiner*—John Barlow

[57] ABSTRACT

An ink jet pen supply cartridge having a spring biased ink bag with a visual indication of remaining ink quantity. The spring-bag reservoir tends to collapse laterally as the ink supply decreases due to differential pressure exerted thereto. The spring-bag is contained in a rigid cartridge and a pair of flexible tape members are cemented or welded, one to each side of the spring-bag, and extend generally parallel toward a narrow end surface of the cartridge at which they overlap and can be viewed through a window. The overlapping relationship of the tape members provide ink quantity indicia which change as the spring-bag collapse draws them past each other.

7 Claims, 2 Drawing Sheets

FIG. 1
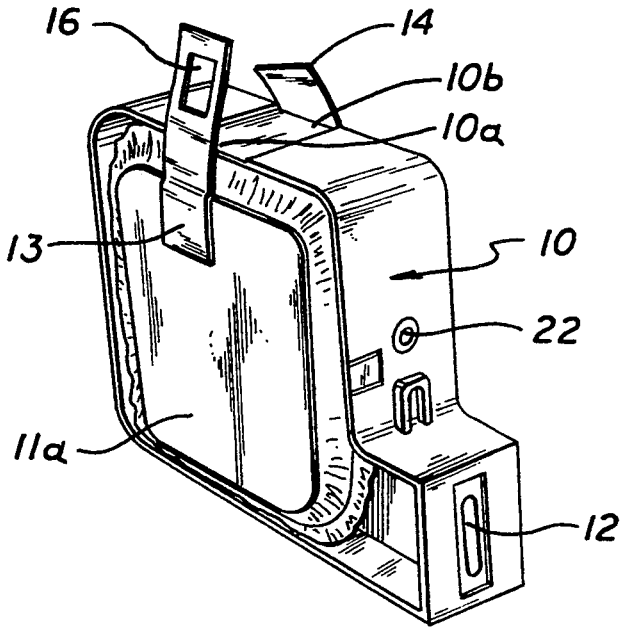
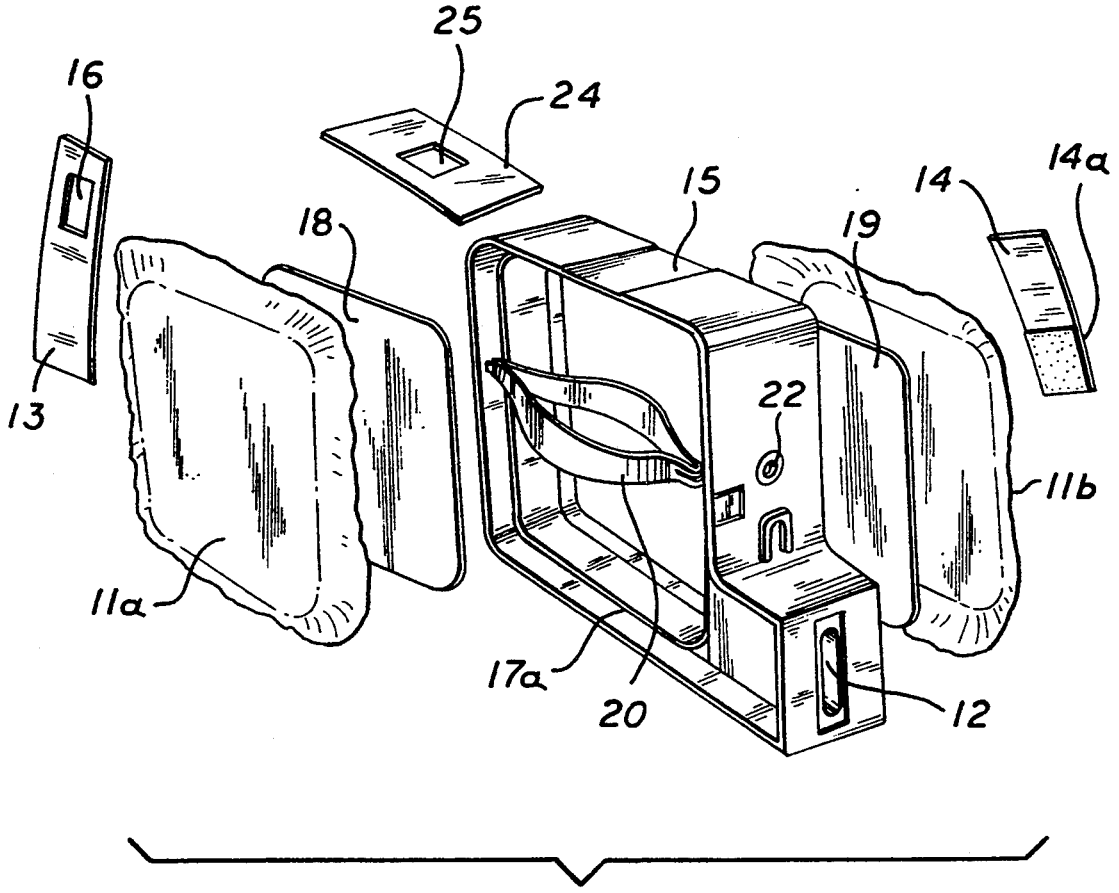
FIG. 2

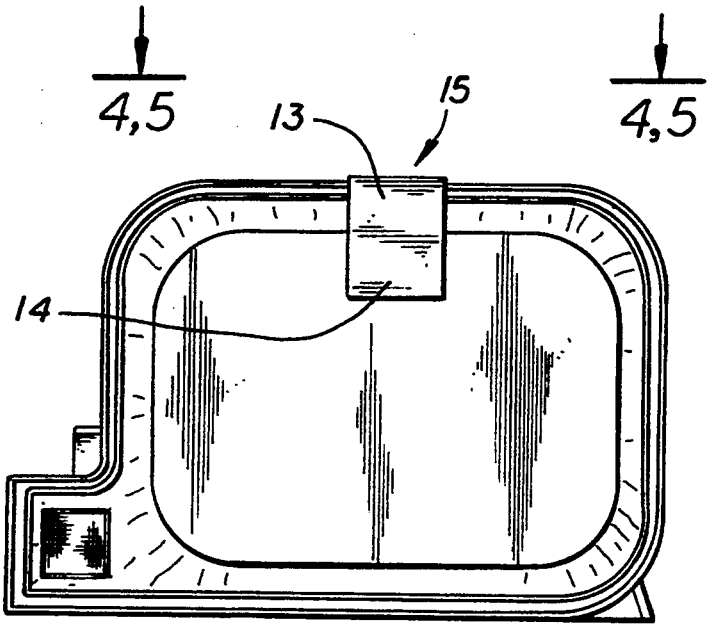
FIG. 3
FIG. 4
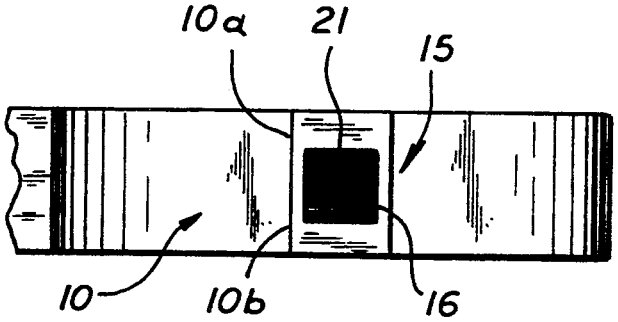
FIG. 5
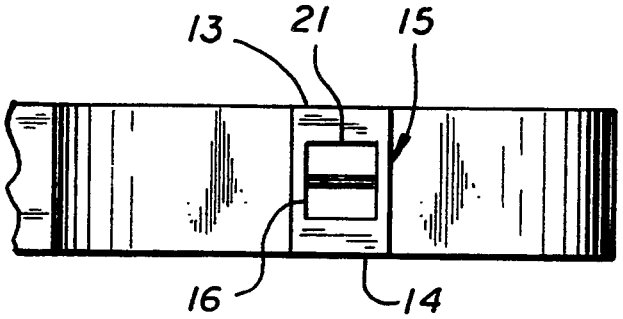

SPRING-BAG PRINTER INK CARTRIDGE WITH VOLUME INDICATOR

FIELD OF THE INVENTION

The invention relates generally to ink reservoirs for high speed ink printers such as color business printers and, more specifically, to residual ink volume indicators for ink reservoir assemblies.

DESCRIPTION OF THE PRIOR ART

In the prior art the problem of monitoring ink level in all types of high speed printers such as ink-jet printers has been variously addressed. So-called back pressure indicators require plural complex seals within the pen/-cartridge assembly and are therefore relatively expensive and tend to be less reliable.

Other ink volume indicators rely on measurement of ink bulk conductivity. The conductivity of the ink is difficult to control and there is the likelihood that future ink improvements could make such a system obsolete.

Whenever dot matrix technology is employed in a printer, and many do employ this technology, there have been attempts to count the "dots" or drops from a given pen. The counters, actuators and sensors needed for such systems make them relatively expensive. Furthermore, accuracy is compromised by the need to assume an average drop volume for all pens. Interruptions such as caused by removal of a pen/cartridge assembly or shut-down of the printer are a further source of unreliability since the record of the number of drops fired from the ink jet since the last update is likely to be lost.

Prior art known to applicants comprises U.S. Pat. Nos. 4,196,625; 4,202,267; 4,371,790; 4,415,886; 4,551,734; 4,587,535; 4,626,874; 4,719,475; and 4,935,751; and pending application Ser. No. 07/423,158 filed Oct. 18, 1989 in the names of John Mohr, et al for a CAPILLARY RESERVOIR INK LEVEL SENSOR and now owned by the assignee of the present invention.

With the exception of U.S. Pat. No. 4,935,751 which is discussed below, and U.S. Pat. No. 4,587,535 which discloses a system of the pressure sensing type, all of the above patents describe monitoring systems which rely on measurement or detection of ink conductivity.

U.S. Pat. No. 4,935,751, owned by the assignee of the present invention, discloses a mechanical level sensor for an ink bag which employs a rigid plate secured to one side of a collapsable ink bag wherein one end of the strip is visible through a window in the ink bag housing. Although the position of the edge of the indicator strip is indicative of the remaining amount of ink in the bag, an "empty" indication appears although a not insignificant amount of useable ink remains in the bag.

None of the prior art references known to applicants provides a simple and inexpensive ink volume indicator. In fact, even if the enclosure is transparent, visual observation of ink in a collapsable ink bag reservoir is not reliable since the collapse of the bag as ink is used does not produce direct level change although volume change is, of course, occurring.

The manner in which the invention advances the state of the art in respect to ink volume monitoring in a collapsable bag reservoir assembly will be evident as the disclosure proceeds.

SUMMARY OF THE INVENTION

The monitoring of reservoir residual ink volume in a disposable ink bag system requires an inexpensive, easily manufactured arrangement. The invention is such a device suitable for disposable reservoirs although the teachings herein are equally applicable to refillable reservoirs.

In the present invention, change of reservoir volume due to negative pressure extraction of the ink during operation causes lateral collapse of a flexible bag against outward pressure of a spring arrangement which assists in maintaining negative pressure in the bag and in centering the bag in the housing as ink is removed so that the ink volume indicator provides reliable information to the user.

The spring acts against a pair of plates bonded to the walls of the bag urging the walls apart so as to maintain a negative pressure in the ink reservoir bag. Accordingly, the negative pressure in the ink reservoir maintained at all times by the spring-bag reliably prevents leakage of ink from the reservoir unless the ink is drawn therefrom by printer operation.

One, and preferably two, tapes or film strips affixed to the flexible bag are arranged such that they overlap and are drawn apart as the bag collapses thus providing or revealing indicia viewable through a window in the reservoir housing to provide an indication of remaining ink in the reservoir.

BRIEF DESCRIPTION OF THE DRAWINGS

FIG. 1 is a perspective view of the reservoir assembly and residual ink volume indicating device of the present invention.

FIG. 2 is an exploded view of a spring-bag ink reservoir assembly prior to the inclusion of ink volume indicating elements, with those elements shown by themselves.

FIG. 3 is a side view of the ink reservoir without the outer enclosure.

FIG. 4 is a top view of FIG. 3 showing a window in an overlaying film strip and indicia on an underlying strip indicating the condition of nearly full ink supply.

FIG. 5 is a top view of FIG. 3 showing the window in the overlying film strip and the indicia on the underlying film strip indicating the condition of nearly depleted ink supply.

DETAILED DESCRIPTION

Referring to FIG. 1, a rigid outer enclosure or housing is depicted having a peripheral narrow wall 10 and a pair of parallel opposed side walls (not shown) which are affixed to peripheral wall 10 to enclose a spring biased ink bag. This enclosure is usually opaque material such as black plastic and is comprised of the peripheral wall 10 and a pair of side plates (not shown) which are welded or glued thereto after installation of the internal components. One side of the flexible bag is visible at 11*a* with ink-jet orifices shown at 12 which are placed into fluid communication with the interior of the bag in a manner which is conventional. The peripheral wall 10 is provided with a pair of spaced parallel slots 10*a* and 10*b* on opposite sides of reduced thickness viewing space 15 (FIG. 2) which slots respectively receive thin plastic film strips 13 and 14 which are cemented or welded to opposite sides of bag 11 and which pass through the slots 10*a* and 10*b* and fold over each other into the space 15. Strip 14 is the lower or inside strip having, e.g., a green color which provides indicia visible through window 16 in strip 13 when both strips are in place. Strip 13 is preferably of the same color (e.g., black) as the plastic housing material. Reduced thickness space 15 in peripheral wall 10 which receives the overlying strips 13 and 14 may then be covered with a tape or plate 24 having a stationary viewing window 25 therein which is aligned with the path of movement of the window 16 in strip 13. This permits visual observation of the movement of strip 13 and of the contrasting color (green) film strip 14.

Referring now to FIG. 2, the sides of the spring bag 11 are identified at 11*a* and 11*b*. The flexible plastic material bag sides 11*a* and 11*b* are secured by cement or thermoplastic fusion onto the inner edges (typically along 17*a*) of the housing peripheral wall 10. Intervening metal panels 18 and 19 bear against the inside surfaces of bag sides 11*a* and 11*b* and are held in place by the outward pressure from a double-bowed compression spring 20. Spring 20 may be attached to panels 18 and 19 but may be assumed to stay in place without attachment once the assembly is completed.

The bag 11 is filled with ink via port 22 which is subsequently plugged for shipment. The required means which fire the ink droplets through the orifices 12 is conventional and causes progressive collapse of the spring bag such that its sides 11*a* and 11*b* retreat equal distances inwardly in the housing as the ink volume is decreased.

Strip 14 is illustrated with an adhesive surface 14*a* and it is understood that a similar adhesive is affixed to strip 13 for attachment of the strips 13 and 14 to the spring-bag sides 11*a* and 11*b*, respectively.

Referring now to FIG. 3, the edge portion of peripheral wall 10 is shown, however the rigid side panels are omitted for illustrative purposes.

FIG. 4 shows a substantially full condition indication (all green) whereas FIG. 5 shows the indicator appearance when the ink supply is nearly exhausted—a narrow strip of green substantially in the center of the stationary window 25 with the remainder of the window 25 appearing as black. This appearance of from all green to a gradually narrowing and centered strip of green is caused by the viewer seeing black from the black housing gradually beginning to appear from the left (due to the rightwardly retreating edge of green strip 14) and from the right (due to the leftwardly moving black right edge of window 16 in strip 13). This appearance is obtained when the housing 10 is the same color (black) as the strip 13 but it will be appreciated that other color combinations or types of indicia may be chosen within the spirit of the invention. The action of spring 20 ordinarily can be expected to keep the collapsible bag centered in the housing so that the narrowing stripe of green in window is kept centered therein, although such centering is not essential.

From the foregoing, it will be realized that, as the ink supply decreases, bag sides 11*a* and 11*b* retreat inwardly and the film strips 13 and 14, passed through slots 10*a* and 10*b* the reduced thickness portion of peripheral wall 10 and folded over the side edges thereof, are pulled apart from each other to progressively expose the contrasting color (black) of the housing and overlying strip 13 through the stationary window 25.

The relative movement of the film strips 13 and 14 is substantially independent, even if bag sides 11*a* and 11*b* do not collapse inwardly by the same amount. The stationary window 25 is preferably elongated normal to the spring-bag sides 11*a* and 11*b* to allow for some variation in bag collapse between sides 11*a* and 11*b*.

The skilled reader will realize that variations of the disclosed structure within the spirit of the invention are possible and accordingly it is not intended that the scope of the invention should be considered limited to the specifics of the drawings or this description, these being typical and illustrative only.

One variation could involve a one sided film strip attachment with a window such as 16 working against indicia inscribed on the reduced thickness portion of peripheral wall 10. Such a variation would be less accurate than the disclosed double strip arrangement unless a spring-bag were developed with one fixed side so that all collapsing motion would occur in the other side.

As a further development, optical or magnetic sensors could be arranged to view the optically or magnetically visible indicia to trigger an external warning light display.

It will be realized that the invention presents a simple and inexpensive modification of a prior art spring-bag ink reservoir/pen cartridge entirely consistent with the expendable cartridge concept.

We claim:

1. A negative pressure ink reservoir cartridge comprising:

a housing having a rigid wall defining a perimeter of said cartridge;

a flexible ink bag disposed in said housing inside said rigid wall, said bag having a pair of opposed substantially parallel side walls, at least one of said side walls being moveable toward the other of said side walls inside of said rigid wall of said housing;

at least one rigid panel in said bag engaged with said moveable side wall of said bag, said rigid wall being substantially parallel to said side walls of said bag;

spring means for biasing said panel and moveable side wall apart from said other side wall of the bag in said housing to establish an ink reservoir as a spring-bag from which ink is withdrawn;

at least one flexible strip attached to one of said side walls and folded over an edge of said rigid housing wall, said strip having ink volume indicia thereon;

and said housing having a stationary window along said rigid wall through which said indicia may be monitored as said strip moves past said window during depletion of the ink in said bag.

2. The cartridge of claim 1 in which said bag has a pair of said opposed moveable walls secured at their periphery to the inside of said housing, a pair of said rigid panels inside said bag respectively engaged with said moveable bag walls, said spring being engageable with each of said panels, and said at least one flexible strip comprises first and second flexible strips folded over opposite edges of said peripheral wall, said first strip overlying said second strip, said second strip including visible indicia and said first strip including a moveable window generally aligned with said indicia to provide a visual indication of residual ink in said spring-bag as a function of a relative translation of said first and second strips.

3. The cartridge of claim 2 in which said stationary window is elongated in a direction of movement of said first and second strips to ensure continuous view of said moveable first strip window during relative translation of said first and second strips.

4. The cartridge of claim 2 in which said second strip indicia comprises a colored area located to show through said moveable first strip window when said spring-bag is substantially full of ink and said first strip and said housing being of colors which contrast with the color of said colored area.

5. The cartridge of claim 3 in which said second strip indicia comprises a colored area located to show through said moveable first strip window when said spring-bag is substantially full of ink and said first strip and said housing being of colors which contrast with the color of said colored area.

6. The cartridge of claim 2, wherein said spring means is a double bowed spring.

7. The cartridge of claim 4, wherein said spring means is a double bowed spring.

* * * * *